US009807510B2

(12) United States Patent
Graber

(10) Patent No.: US 9,807,510 B2
(45) Date of Patent: Oct. 31, 2017

(54) TRANSDUCER

(71) Applicant: Curtis E. Graber, Woodburn, IN (US)

(72) Inventor: Curtis E. Graber, Woodburn, IN (US)

( * ) Notice: Subject to any disclaimer, the term of this patent is extended or adjusted under 35 U.S.C. 154(b) by 0 days.

(21) Appl. No.: 15/151,908

(22) Filed: May 11, 2016

(65) Prior Publication Data

US 2017/0041714 A1 Feb. 9, 2017

Related U.S. Application Data

(62) Division of application No. 14/817,513, filed on Aug. 4, 2015, now Pat. No. 9,668,060.

(51) Int. Cl.

| | |
|---|---|
| ***H04R 9/02*** | (2006.01) |
| *H04R 1/02* | (2006.01) |
| *H04R 9/04* | (2006.01) |

(52) U.S. Cl.

CPC ..... *H04R 9/025* (2013.01); *H04R 1/021* (2013.01); *H04R 9/04* (2013.01); *H04R 2209/021* (2013.01); *H04R 2209/022* (2013.01)

(58) Field of Classification Search

CPC .... H04R 9/025; H04R 2209/022; H04R 9/06; H04R 1/06; H04R 1/403; H04R 2225/31; H04R 2225/33; H04R 2225/51; H04R 2460/17; H04R 2499/13; H04R 25/305; H04R 25/55; H04R 25/554; H04R 25/602

USPC ..... 381/401–415, 422–425; 310/12.15

See application file for complete search history.

(56) References Cited

U.S. PATENT DOCUMENTS 3,877,314 A * 4/1975 Bernin ..... G01P 15/0891 73/1.38

5,142,260 A * 8/1992 House ..... H04R 9/025 335/222

5,898,544 A * 4/1999 Krinke ..... G11B 5/4833 360/264.5

6,542,617 B1 * 4/2003 Fujihira ..... H04R 9/04 381/400

6,563,932 B2 5/2003 Cork (Continued)

FOREIGN PATENT DOCUMENTS

DE 197 25 373 A1 12/1998

OTHER PUBLICATIONS

Notification of Transmittal of the International Search Report and the Written Opinion of the International Searching Authority, or the Declaration dated Oct. 20, 2016 for International Application No. PCT/US2016/041319 (11 pages).

*Primary Examiner* — Md S Elahee
*Assistant Examiner* — Julie X Dang
(74) *Attorney, Agent, or Firm* — Taylor IP, P.C.

(57) ABSTRACT

A transducer including a driven element and a magnet assembly. The magnet assembly is coupled to the driven element and includes a first and a second magnet, and a ferrous member. Each of the magnets have a first and second magnetic pole. The first magnetic pole of the first magnet and the first magnetic pole of the second magnet being proximate to each other and facing each other thereby defining a first magnetic zone therebetween, the first magnetic poles being similar, and the second magnetic poles being similar. The ferrous member couples a substantial amount of the magnetic field emanating from the second magnetic poles and directing the substantial amount of the magnetic field to a gap between the ferrous member and the first magnetic zone.

16 Claims, 21 Drawing Sheets

(56) References Cited

U.S. PATENT DOCUMENTS

| | | | | |
|---|---|---|---|---|
| 6,940,992 | B2 | 9/2005 | Stiles | |
| 7,006,654 | B2 | 2/2006 | Stiles et al. | |
| 8,891,809 | B2 | 11/2014 | Danovi | |
| 9,161,141 | B2 * | 10/2015 | Martius | H02J 7/0044 |
| 9,312,924 | B2 * | 4/2016 | Ozaki | H02J 7/025 |
| 2002/0131612 | A1 | 9/2002 | Son | |
| 2004/0086150 | A1 * | 5/2004 | Stiles | H04R 9/025 381/421 |
| 2005/0031154 | A1 | 2/2005 | Stiles | |
| 2005/0190945 | A1 | 9/2005 | Calderwood et al. | |
| 2006/0182303 | A1 * | 8/2006 | Trandafir | H01F 7/066 381/409 |
| 2006/0204028 | A1 | 9/2006 | Lim | |
| 2007/0075906 | A1 * | 4/2007 | Forster | B65D 25/205 343/767 |
| 2011/0062916 | A1 * | 3/2011 | Farahani | H01Q 1/248 320/108 |
| 2012/0051188 | A1 | 3/2012 | Graber | |
| 2012/0257646 | A1 * | 10/2012 | Yee | G05D 23/192 372/36 |
| 2013/0142364 | A1 * | 6/2013 | Heed | H04R 9/025 381/182 |

* cited by examiner

TRANSDUCER

CROSS REFERENCE TO RELATED APPLICATIONS

This is a divisional application based upon U.S. non-provisional patent application Ser. No. 14/817,513, entitled "TRANSDUCER", filed Aug. 4, 2015, which is incorporated herein by reference.

BACKGROUND OF THE INVENTION

1. Field of the Invention

The present invention relates to transducers and more specifically to transducers that use a magnet assembly, such as speaker systems.

2. Description of the Related Art

A speaker is a type of electro-acoustic transducer, which is a device that converts an electrical audio signal into sound corresponding to the signal. Speakers were invented during the development of telephone systems in the late 1800s. However, it was electronic amplification, initially by way of vacuum tube technology beginning around 1912 that began to make speaker systems practical. The amplified speaker systems were used in radios, phonographs, public address systems and theatre sound systems for talking motion pictures starting in the 1920s.

The dynamic speaker, which is widely used today, was invented in 1925 by Edward Kellogg and Chester Rice. A principle of the dynamic speaker is when an electrical audio signal input is applied through a voice coil, which is a coil of wire suspended in a circular gap between the poles of a permanent magnet, the coil is forced to move rapidly back and forth due to Faraday's law of induction. The movement causes a diaphragm, which is generally conically shaped, and is attached to the coil to move back and forth, thereby inducing movement of the air to create sound waves.

Speakers are typically housed in an enclosure and if high quality sound is required, multiple speakers may be mounted in the same enclosure, with each reproducing part of the audio frequency range. In this arrangement the speakers are individually referred to as "drivers" and the entire enclosure is referred to as a speaker or a loudspeaker. Small speakers are found in various devices such as radio and TV receivers, and a host of other devices including phones and computer systems.

A problem with electrical transducers in general and speakers in particular is that speaker efficiency, which is defined as the sound power output divided by the electrical power input, is only about 1%. So very little of the electrical energy sent by an amplifier to a typical speaker is converted to acoustic energy. The remainder of the energy is converted to heat, mostly in the voice coil and magnet assembly. The main reason for this is the difficulty of achieving a proper impedance matching between the acoustic impedance of the drive unit and the air it radiates into. The efficiency of speaker drivers varies with frequency as well as the magnetic intensity available to interact with the voice coil.

What is needed in the art is an electro-acoustic transducer that can be used with speakers or other devices which has increased effectiveness that will allow more compact designs and will result in more efficient production of sound or movement.

SUMMARY OF THE INVENTION

The present invention provides a transducer that uses a magnetic assembly having an intense magnetic field.

The present invention in one form is a transducer including a driven element and a magnet assembly. The magnet assembly is coupled to the driven element and includes a first and a second magnet, and a ferrous member. Each of the magnets have a first and second magnetic pole. The first magnetic pole of the first magnet and the first magnetic pole of the second magnet being proximate to each other and facing each other thereby defining a first magnetic zone therebetween, the first magnetic poles being similar, and the second magnetic poles being similar. The ferrous member couples a substantial amount of the magnetic field emanating from the second magnetic poles and directing the substantial amount of the magnetic field to a gap between the ferrous member and the first magnetic zone.

The present invention in another form is directed to a speaker system including an enclosure and a speaker mounted in the enclosure. The speaker includes a driven element and a magnet assembly. The magnet assembly is coupled to the driven element and includes a first and a second magnet, and a ferrous member. Each of the magnets have a first and second magnetic pole. The first magnetic pole of the first magnet and the first magnetic pole of the second magnet being proximate to each other and facing each other thereby defining a first magnetic zone therebetween, the first magnetic poles being similar, and the second magnetic poles being similar. The ferrous member couples a substantial amount of the magnetic field emanating from the second magnetic poles and directing the substantial amount of the magnetic field to a gap between the ferrous member and the first magnetic zone.

The present invention advantageously produces an intense magnetic field.

Another advantage of the present invention is that it allows transducers to efficiently utilize the electrical power provided thereto.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
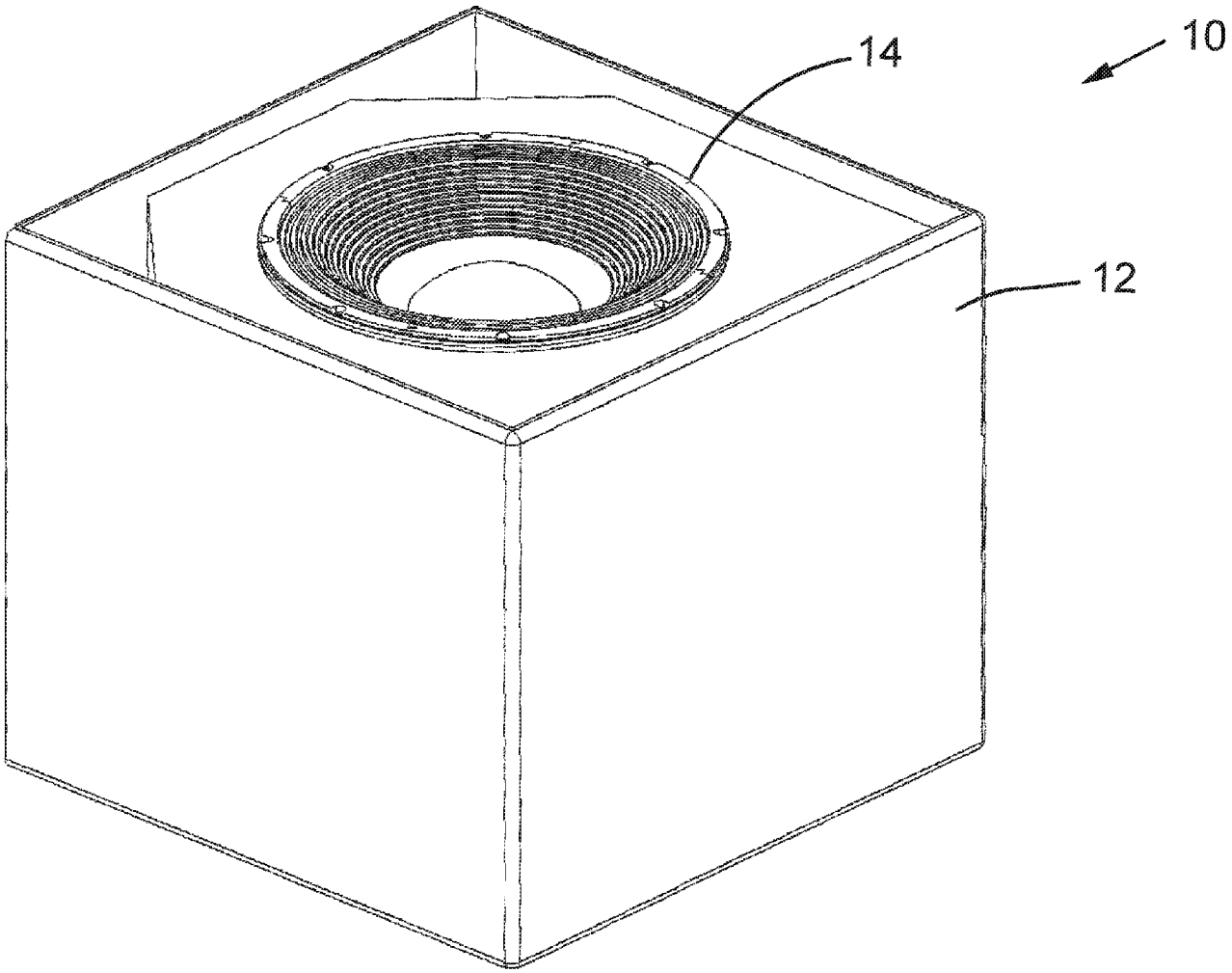
FIG. 1 is a perspective view of a speaker system that utilizes an embodiment of a transducer of the present invention.
Figure 2:
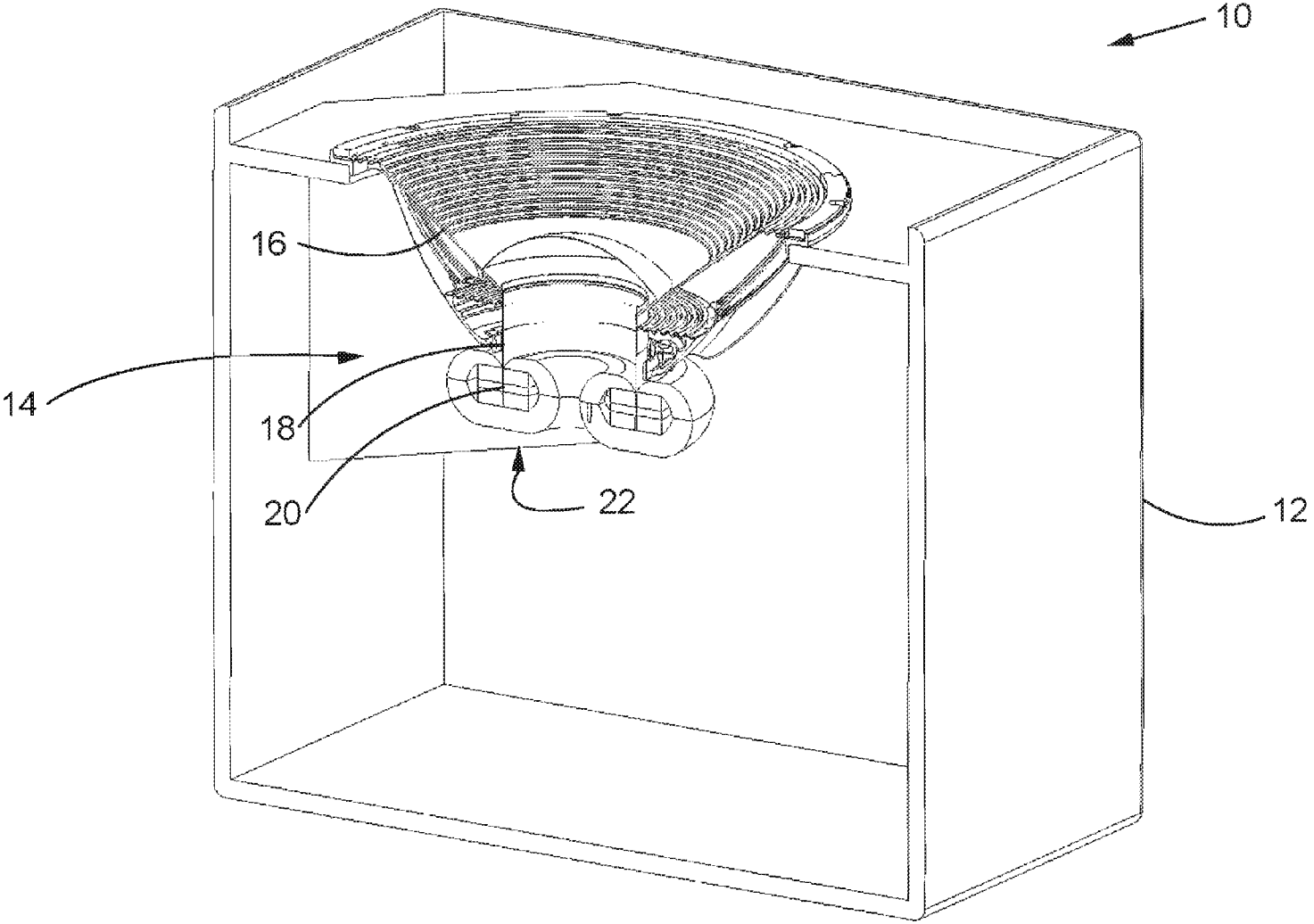
FIG. 2 is a cut away view of the speaker system of FIG. 1.

Referring now to the drawings, and more particularly to FIGS. 1 and 2, there is shown a speaker system 10 including an enclosure 12 and a transducer 14 in the form of an acoustic speaker 14. Speaker 14 includes a driven element 16-20 that is a speaker diaphragm 16 or cone 16, a collar 18 and a voice coil 20. Diaphragm 16 is suspended around its periphery and is moved by collar 18 to produce movements of air to thereby produce sound. Voice coil 20 is a winding of wire coupled to the collar 18 that is positioned in a magnetic field of a magnet assembly 22.

Figure 3:
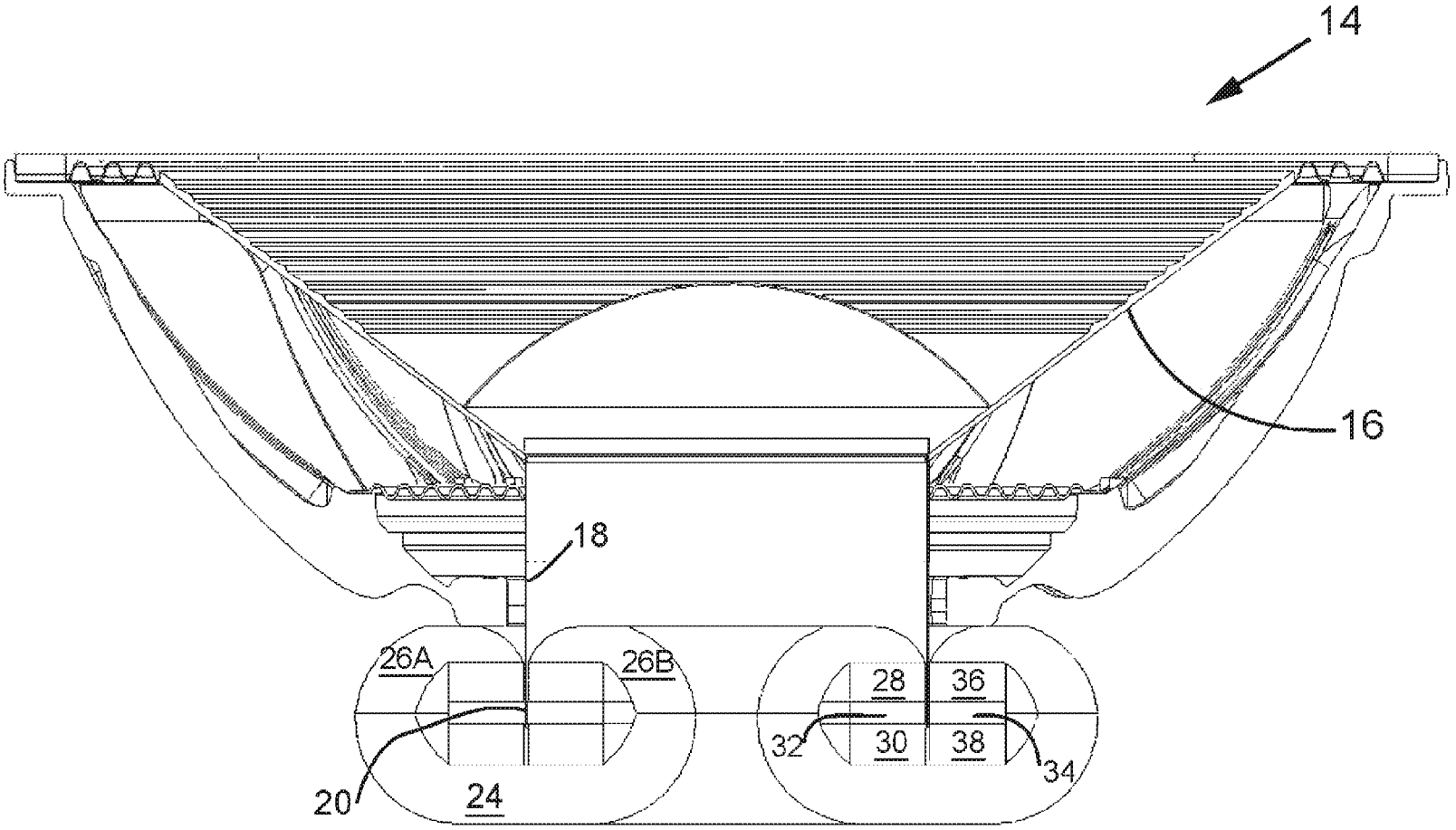
FIG. 3 is a cut away view of a speaker of the speaker system of FIGS. 1 and 2.

Now additionally referring to FIG. 3, there is shown a cut away view of speaker 14 showing more details of magnet assembly 22 which includes ferrous members 24, 26A, 26B magnets 28, 30, 36 and 38, and ferrous members 32 and 34. Ferrous members 24, 26A and 26B together have a combined shape that is similar to a nearly closed C-shape, with collar 18 passing therethrough. Ferrous members 24, 26A and 26B are arranged and shaped in order to largely contain and direct flux from magnets 28, 30, 36 and 38, all of which have a circular form. Ferrous members 32 and 34 can also be thought of as being magnetic zones 32 and 34 that are formed due to the orientation of the magnets in contact with the respective ferrous members 32 and 34.

Figure 4:
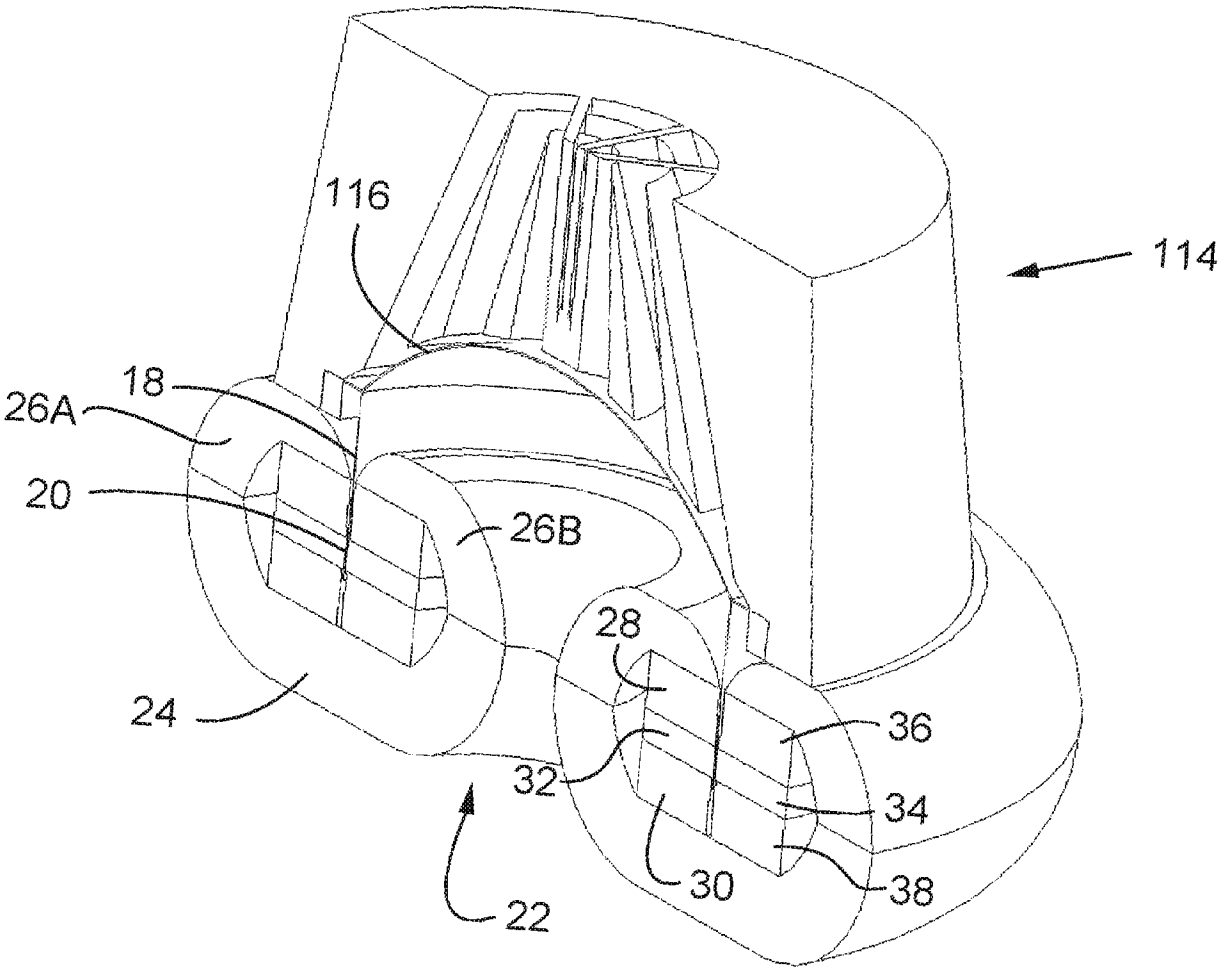
FIG. 4 is a perspective cut away view of another embodiment of a speaker using the transducer of the present invention.
Figure 5:
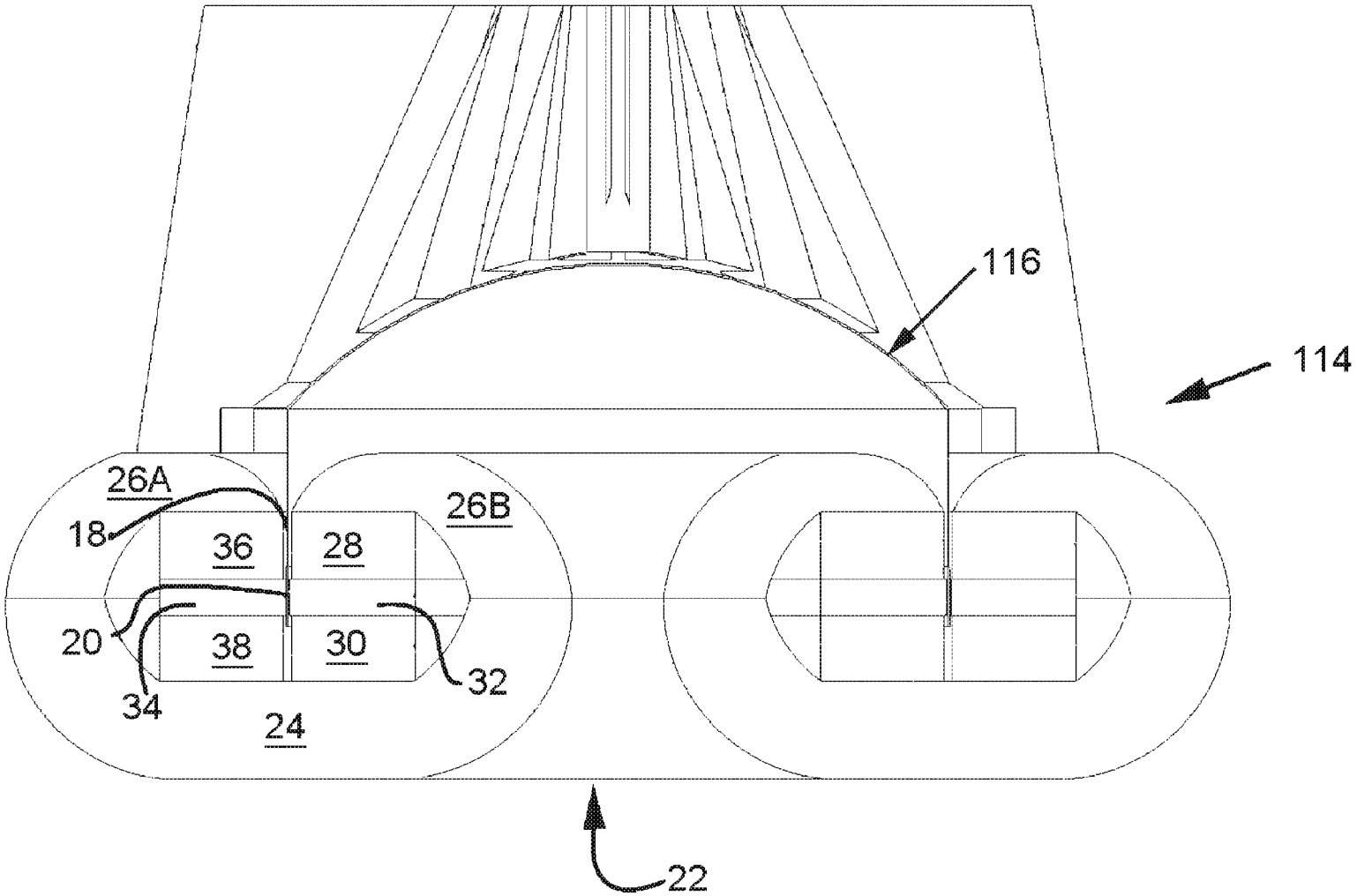
FIG. 5 is a planar cut away view of the speaker of FIG. 4 further illustrating the transducer of the present invention.

Now, additionally referring to FIGS. 4 and 5, there is illustrated another embodiment of a speaker 114. Similar items in the various embodiments have a multiple of 100 associated with its reference number and the descriptions of one corresponds generally to the description of the other, with any differences being specifically discussed.

Figure 6:
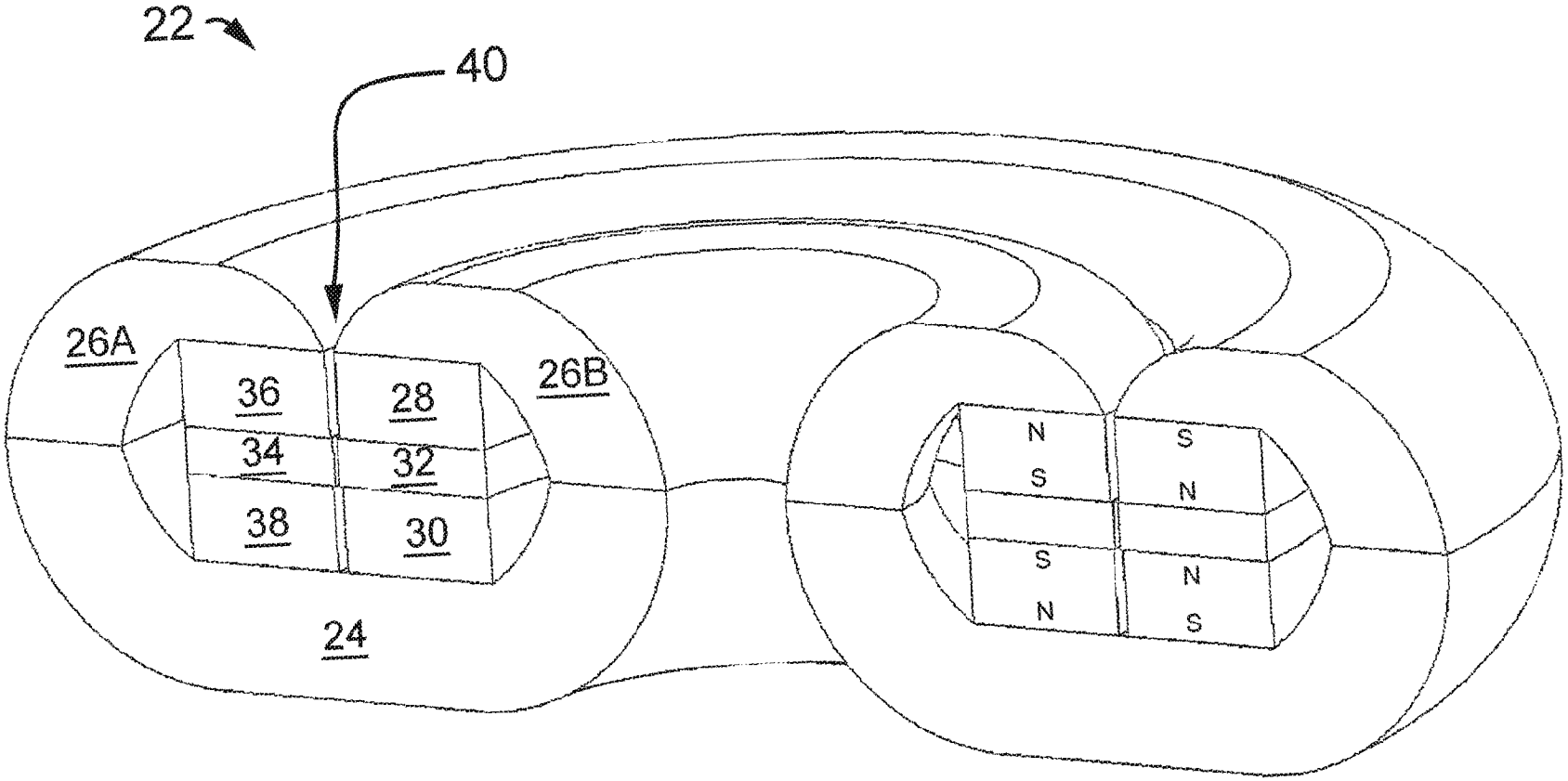
FIG. 6 is a perspective cut away view of the magnetic assembly of the speakers of FIGS. 1-5.
Figure 7:
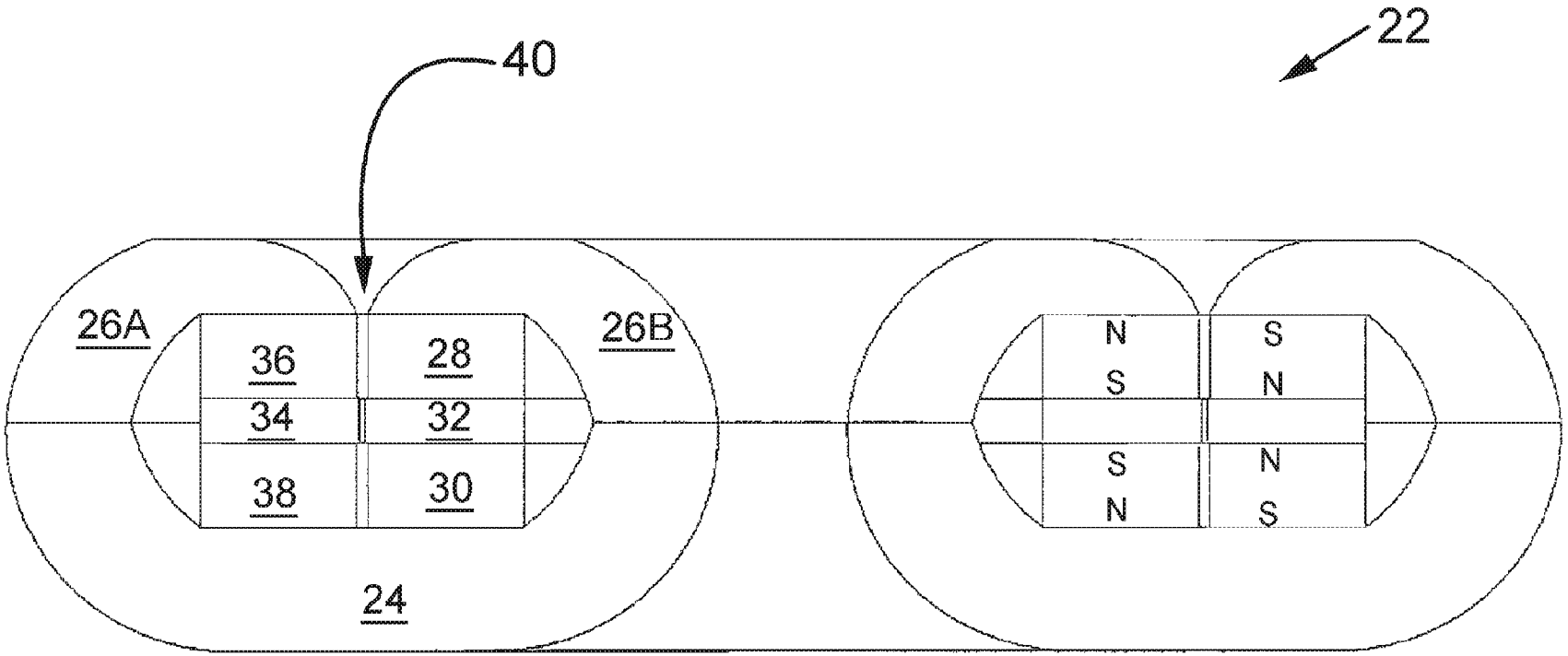
FIG. 7 is a planar cut away view of the magnetic assembly of FIG. 6.

Now, additionally referring to FIGS. 6 and 7 there are shown some additional details of magnet assembly 22. An air gap 40 is illustrated existing between ferrous members 32 and 34, which is where the intensity of the magnetic field is directed and has its most intense focus. The magnetic field strength in this region may be 2 Tesla, or 3 Tesla, or even 4 Tesla, with even higher levels possible. Such a high magnetic field strength will cause the current passing through voice coil 20 to have a much greater effect, to thereby increase the efficiency of transducer 14. The magnetic pole orientation if illustrated on the right side of FIGS. 6 and 7 showing how the poles are arranged in a bucking fashion and will be held in place by the assembly of ferrous members 24, 26A and 26B with fasteners, not illustrated. The ring magnets 28, 30, 36 and 38 may individually have approximately the same field strength, or ring magnets 28 and 30 may have a higher magnetic field density to compensate for their smaller diameter relative to magnets 36 and 38.

Figure 8:
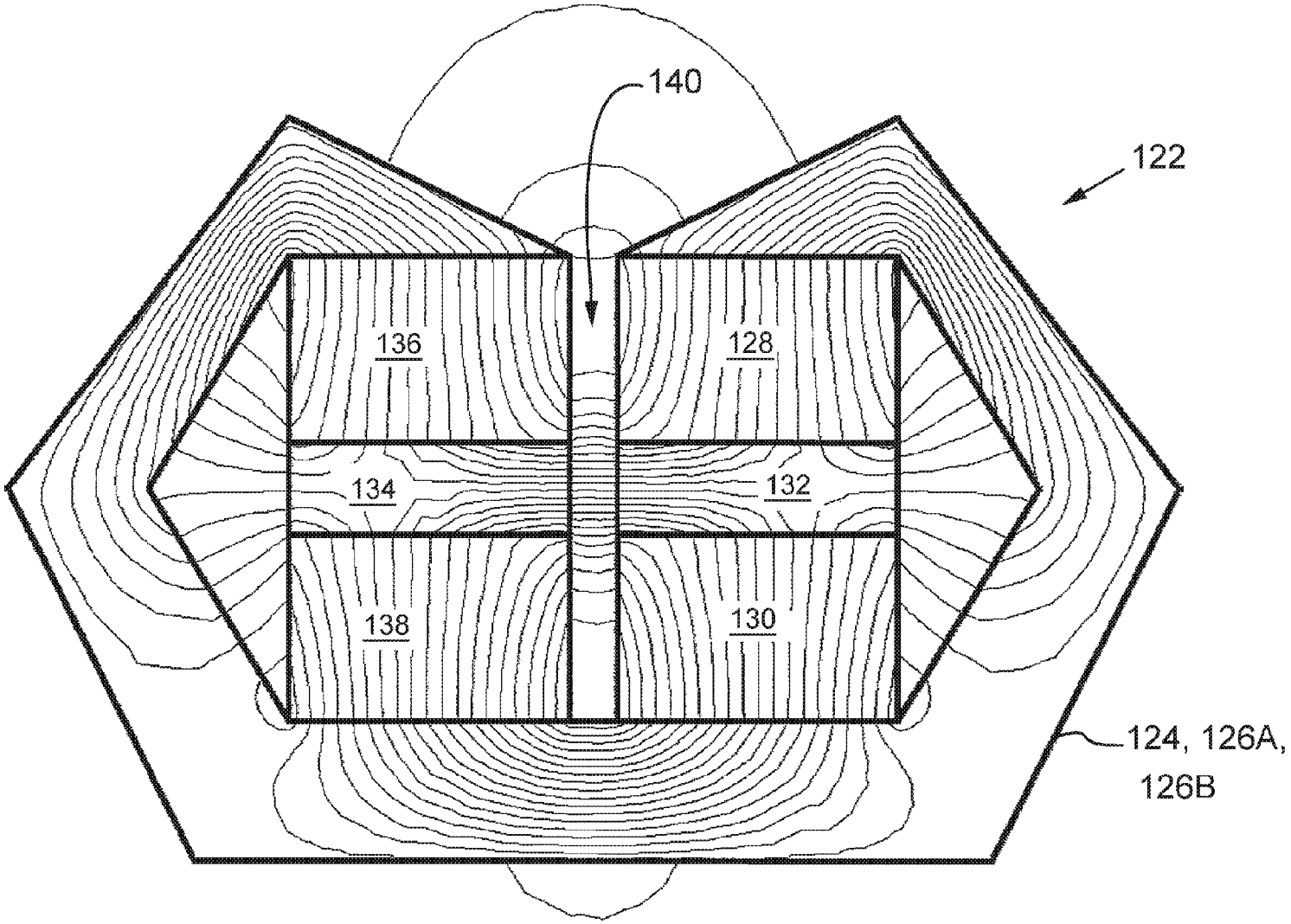
FIG. 8 is a schematical view of the magnetic assembly of FIGS. 6 and 7 illustrating a flow of magnetic flux in the magnetic circuit.

Now, additionally referring to FIG. 8, there is shown a magnet assembly 122, which can be understood to be similar to magnet assembly 22 and illustrates the magnetic circuit thereof. The lines of flux are shown and it can be seen that the highest intensity, illustrated by the closeness of the flux lines, occurs in air gap 140, particularly where ferrous members 132 and 134 are aligned with each other. The field lines are generally and even substantially symmetrical in air gap 140. The construct of ferrous members 124, 126A and 126B are optimized to substantially contain and direct the magnetic flux lines to thereby largely shield the surrounding environment from being influenced by the magnetic filed arranged in magnet assembly 122. The magnetic field lines in ferrous members 132 and 134, can be considered magnetic zones with the area or zone therebetween in air gap 140 having a very intense free air magnetic intensity.

Figure 9:
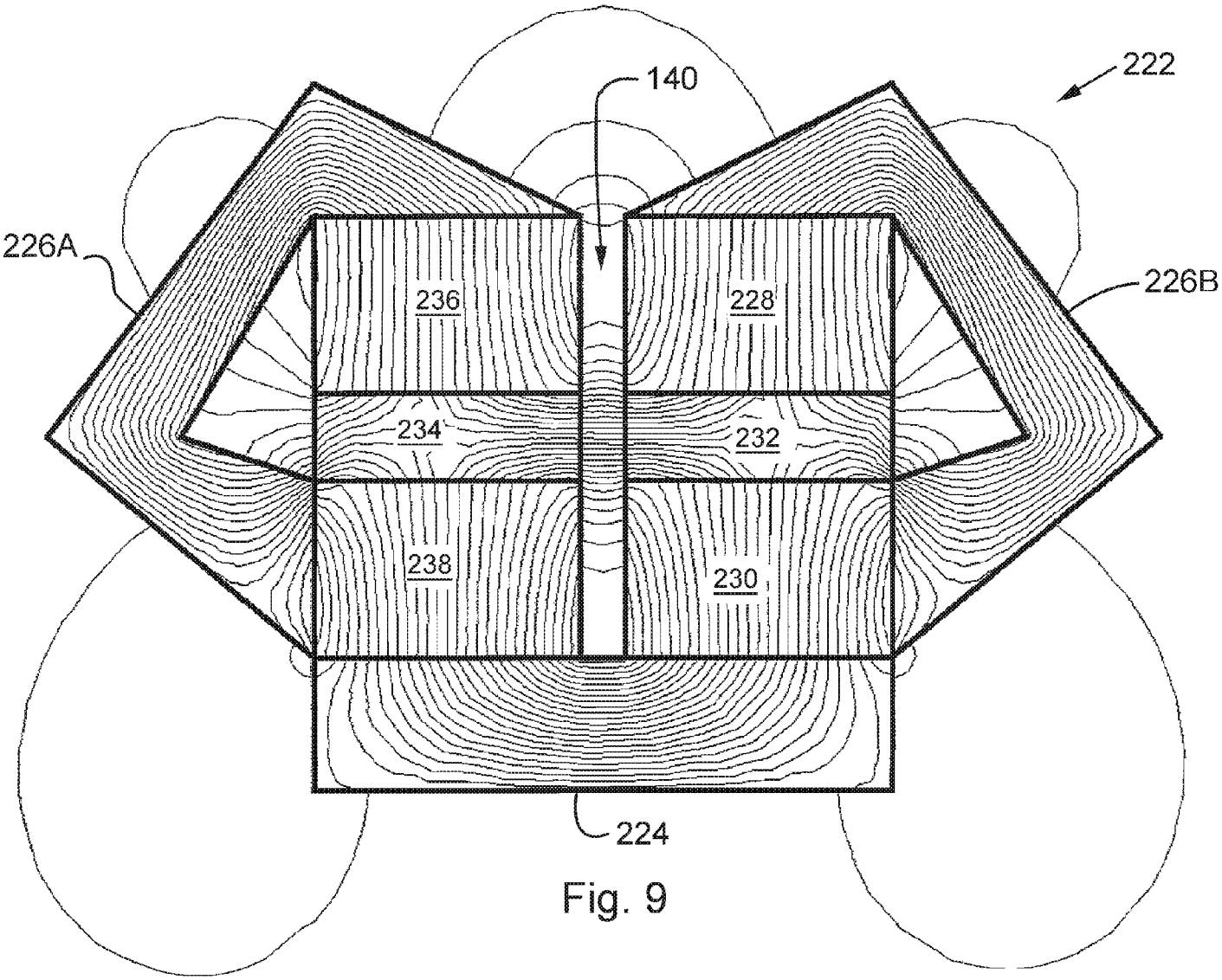
FIG. 9 is a schematical view of another embodiment of a magnetic assembly for use with the speakers of FIGS. 1-5 illustrating a flow of magnetic flux in the magnetic circuit.
Figure 10:
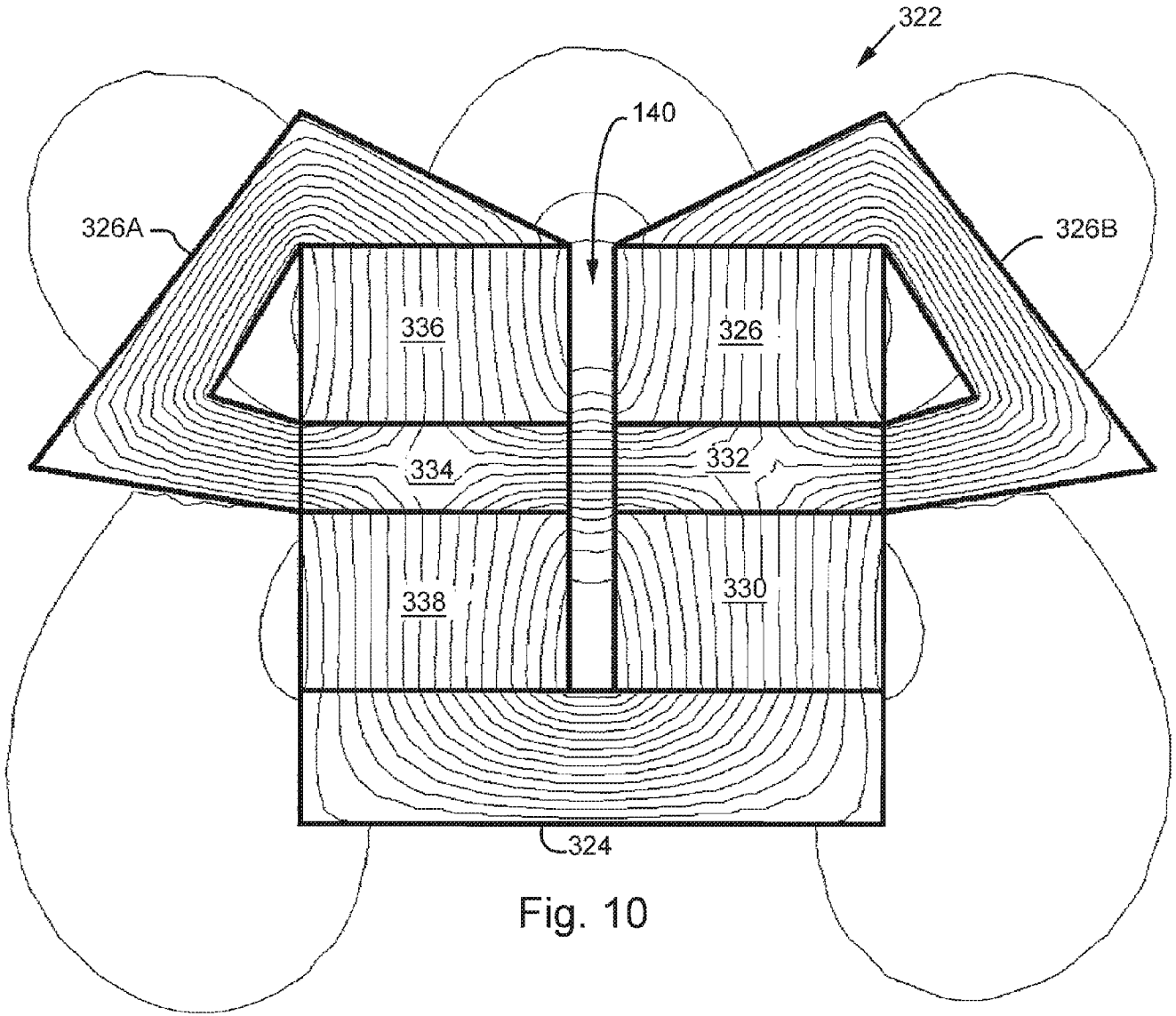
FIG. 10 is a schematical view of yet another embodiment of a magnetic assembly for use with the speakers of FIGS. 1-5 illustrating a flow of magnetic flux in the magnetic circuit.
Figure 11:
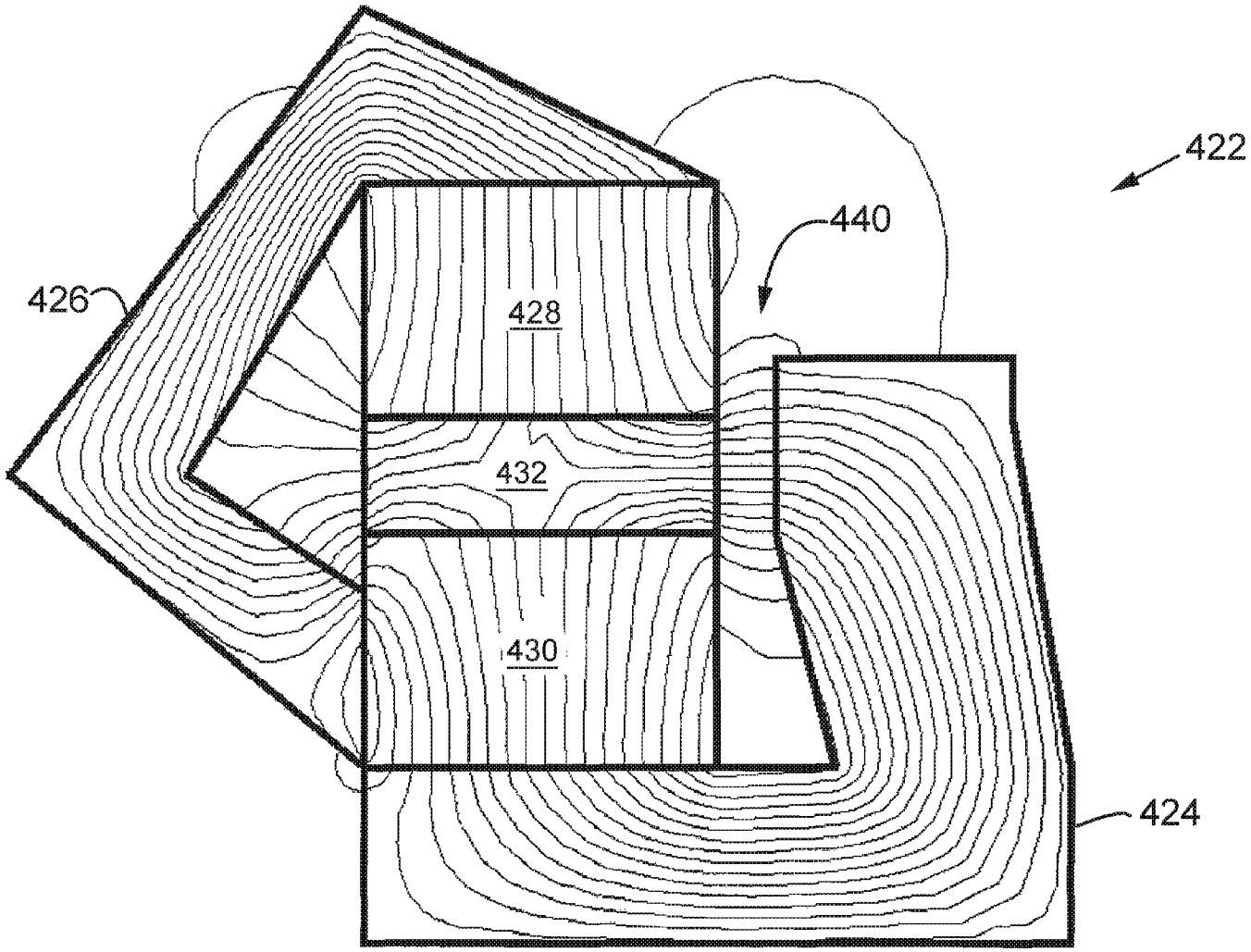
FIG. 11 is a schematical view of still yet another embodiment of a magnetic assembly for use with the speakers of FIGS. 1-5 illustrating a flow of magnetic flux in the magnetic circuit.

Now, additionally referring to FIGS. 9-11, there are illustrated different embodiments of the present invention illustrating variations of possible magnetic circuits that are contemplated that result in the desired high magnetic field strength in air gap 140, 440. The magnetic field symmetry in air gap 140 is nearly absolute and will vary only by the minor variations in the materials used and dimensional considerations. The magnetic field symmetry in air gap 440 is still substantially symmetric in a vertical direction and is substantially symmetrical in a horizontal direction, directly laterally to the right of ferrous member 432. The magnetic field symmetry is still generally symmetrical in directions departing from the lateral outward direction from ferrous member 432.

Figure 12:
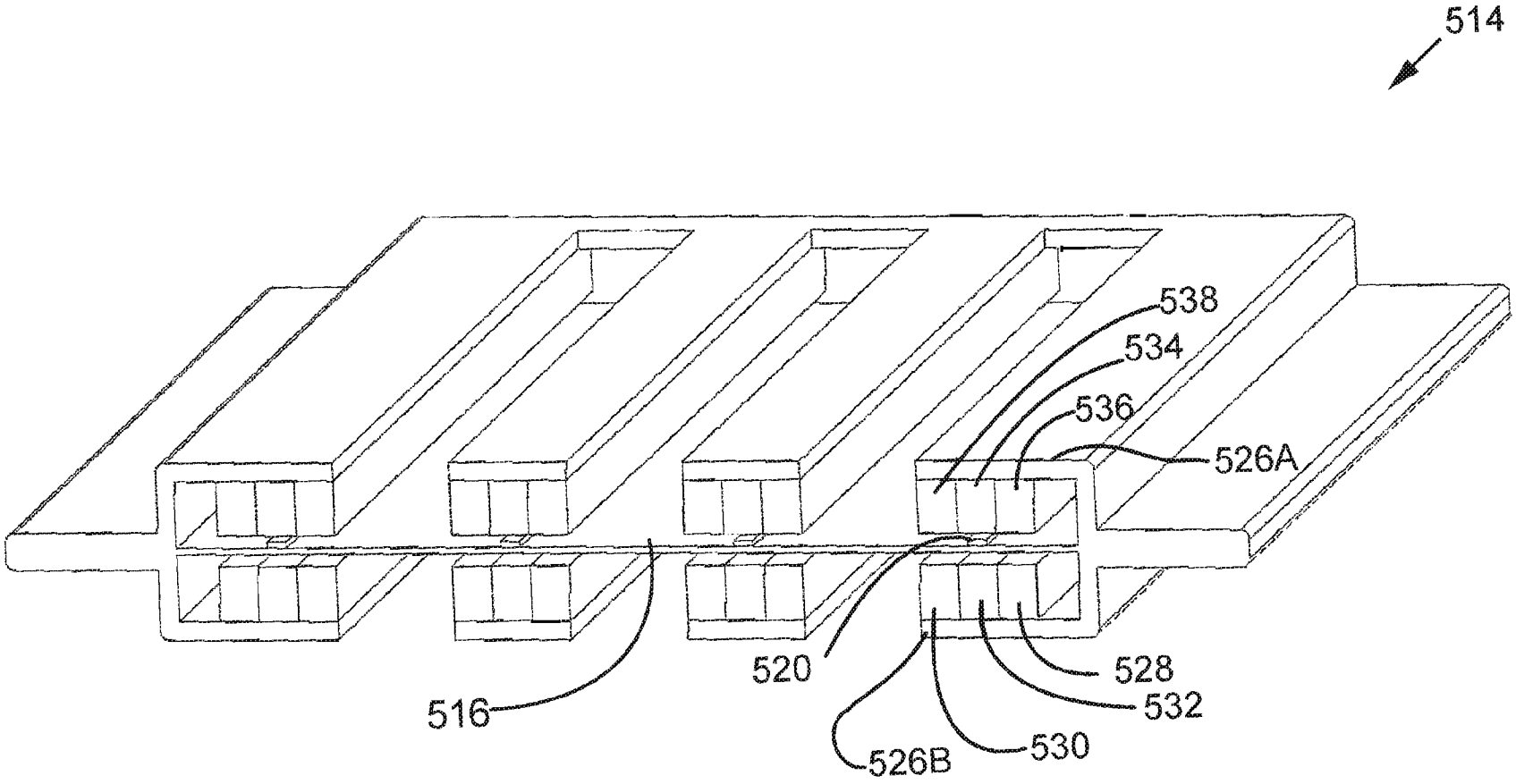
FIG. 12 is a perspective cut away view of an embodiment of a planar transducer in the form of a planar speaker having a magnetic assembly of the present invention.
Figure 13:
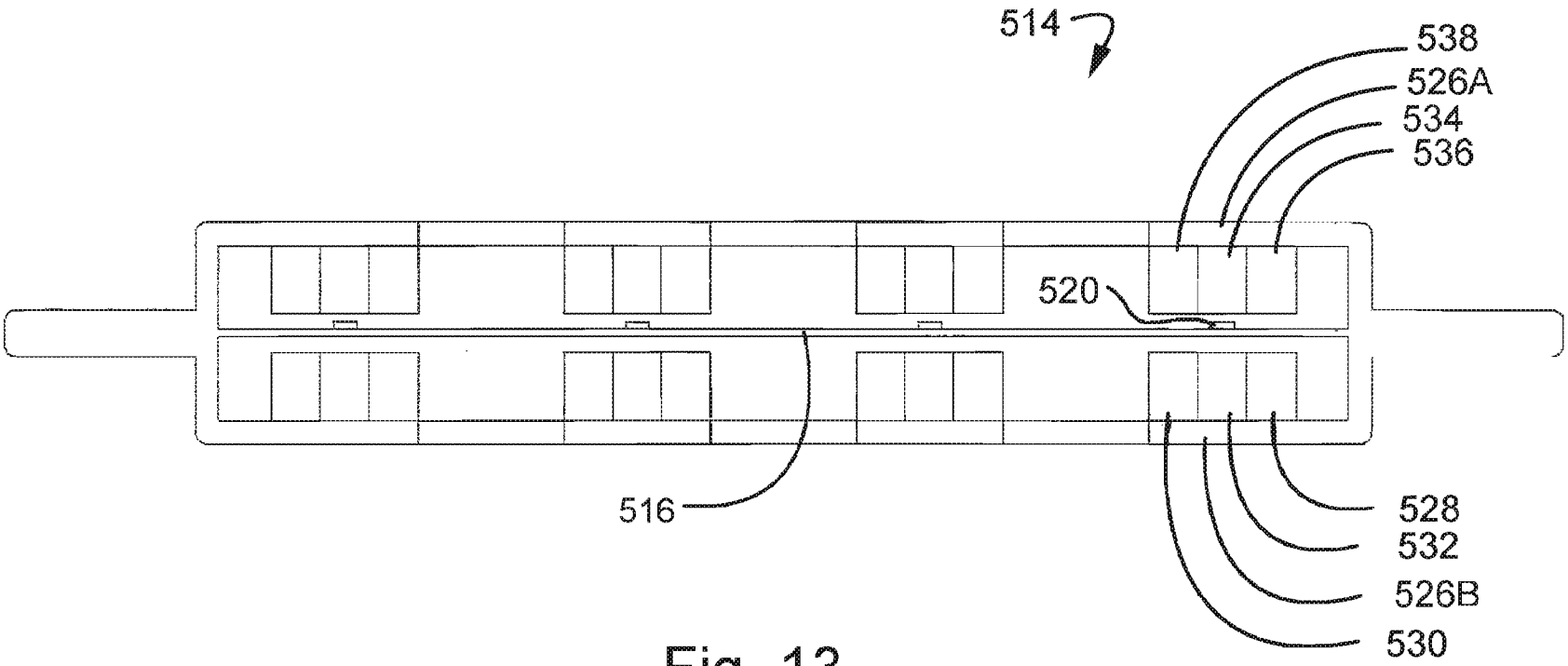
FIG. 13 is a planar cut away view of the speaker of FIG. 12.

Now, additionally referring to FIGS. 12 and 13 there are illustrated another embodiment of the present invention of a transducer 514 in the form of a planar speaker 514. Magnets 528, 530, 536 and 538 are here substantially linear and yet the construct is such that the operation is similar to the previously discussed embodiments. The coil 520 is again positioned in the high intensity magnetic field afforded by the construct geometry.

Figure 14:
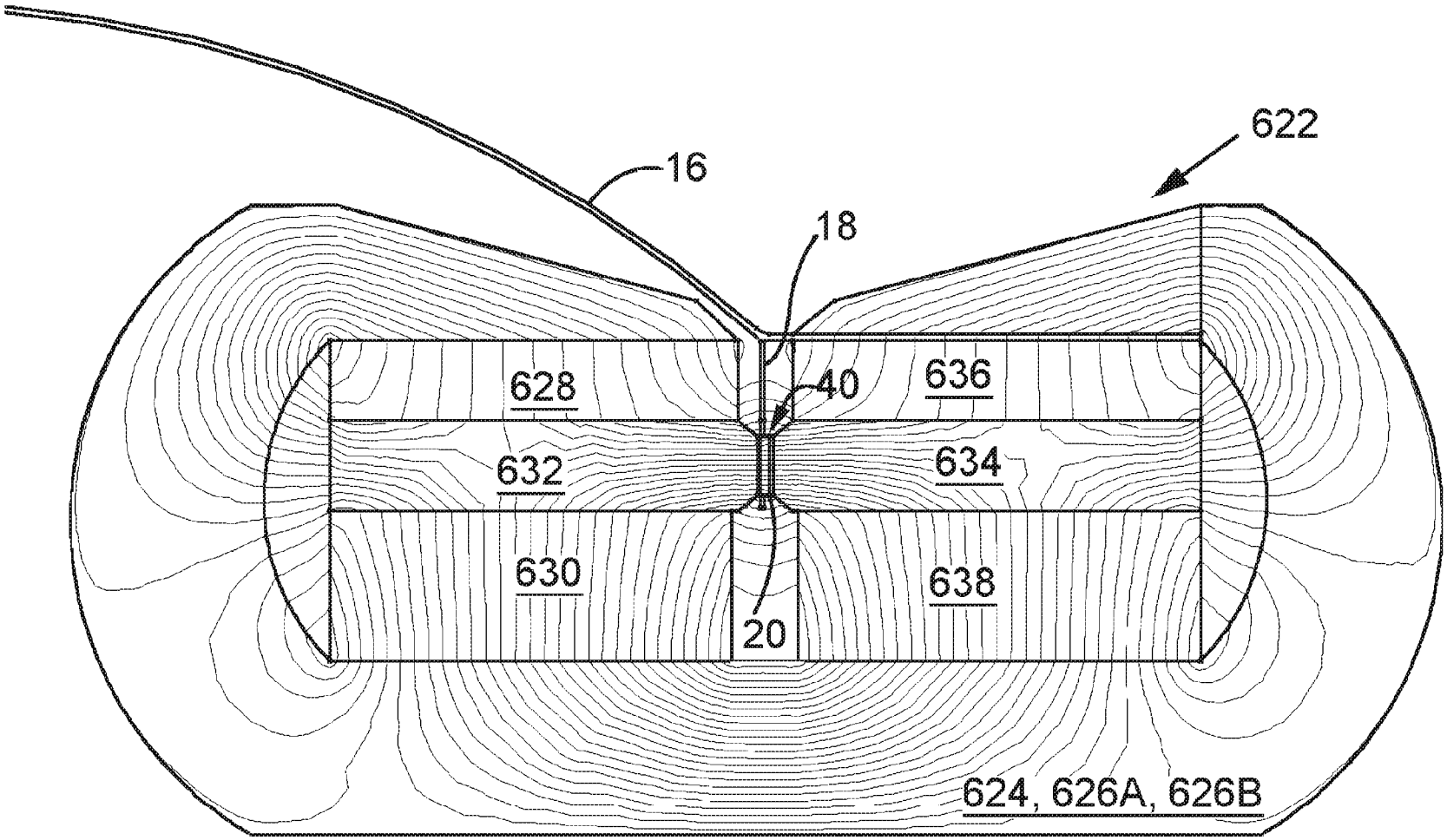
FIG. 14 is another schematical view of a magnetic assembly for use as a transducer of the present invention illustrating the magnetic flux of the magnetic circuit.

Now, additionally referring to FIG. 14, there is illustrated yet another embodiment of the present invention, which illustrates the use of larger and more powerful magnets 630 and 638 relative to magnets 628 and 636. Also ferrous members 632 and 634 have beveled ends that lead to air gap 40 with voice coil 20 being positioned at the focal high intensity magnetic field zone, again having substantial symmetry in the vertical and horizontal directions. As can be seen substantially all of the magnetic field of the magnetic circuit is contained within the construct of magnet assembly 622.

Figure 15:
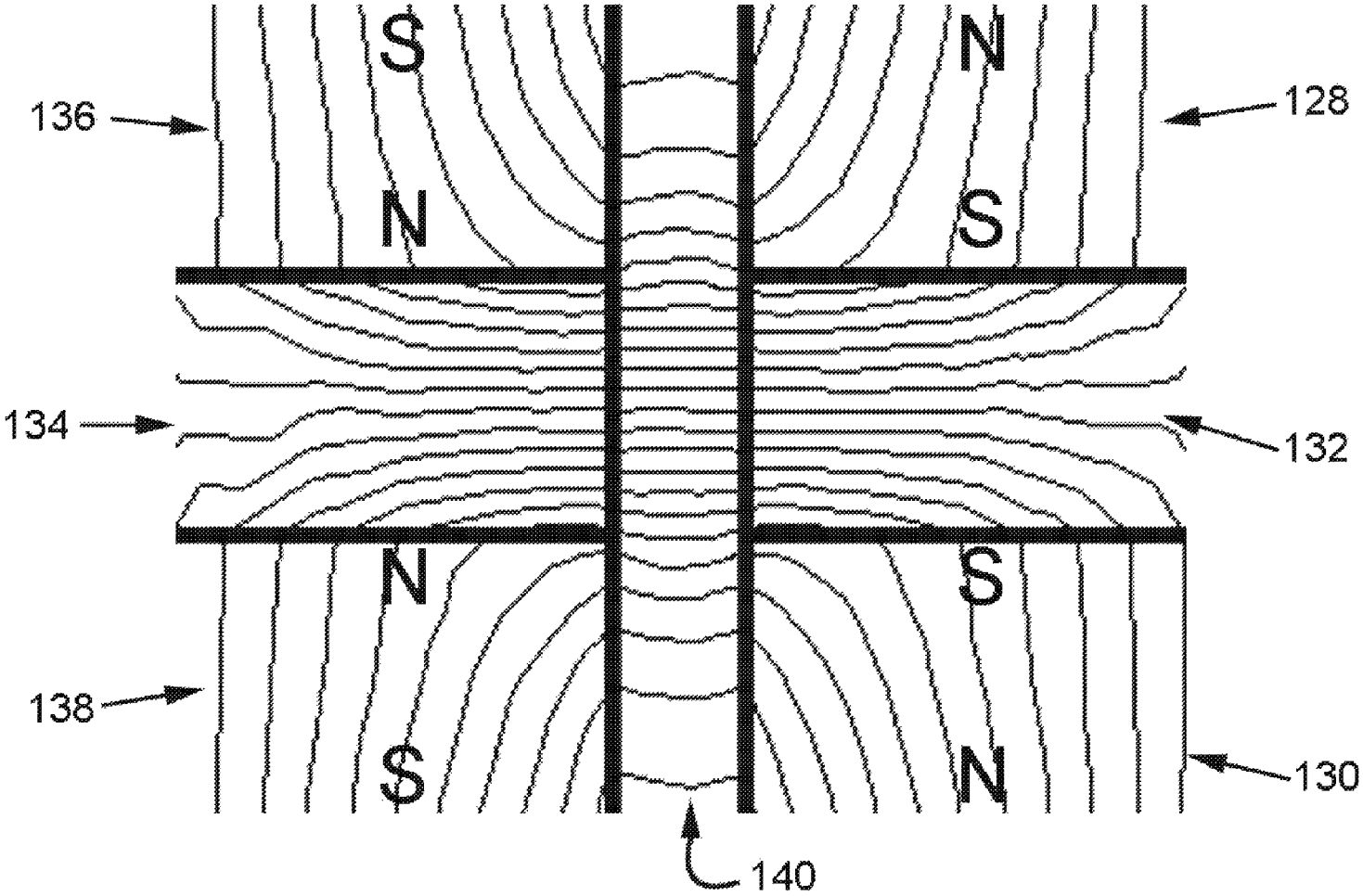
FIG. 15 illustrates a closer view of flux lines associated with the air gap of magnetic assembly of the present invention.
Figure 16:
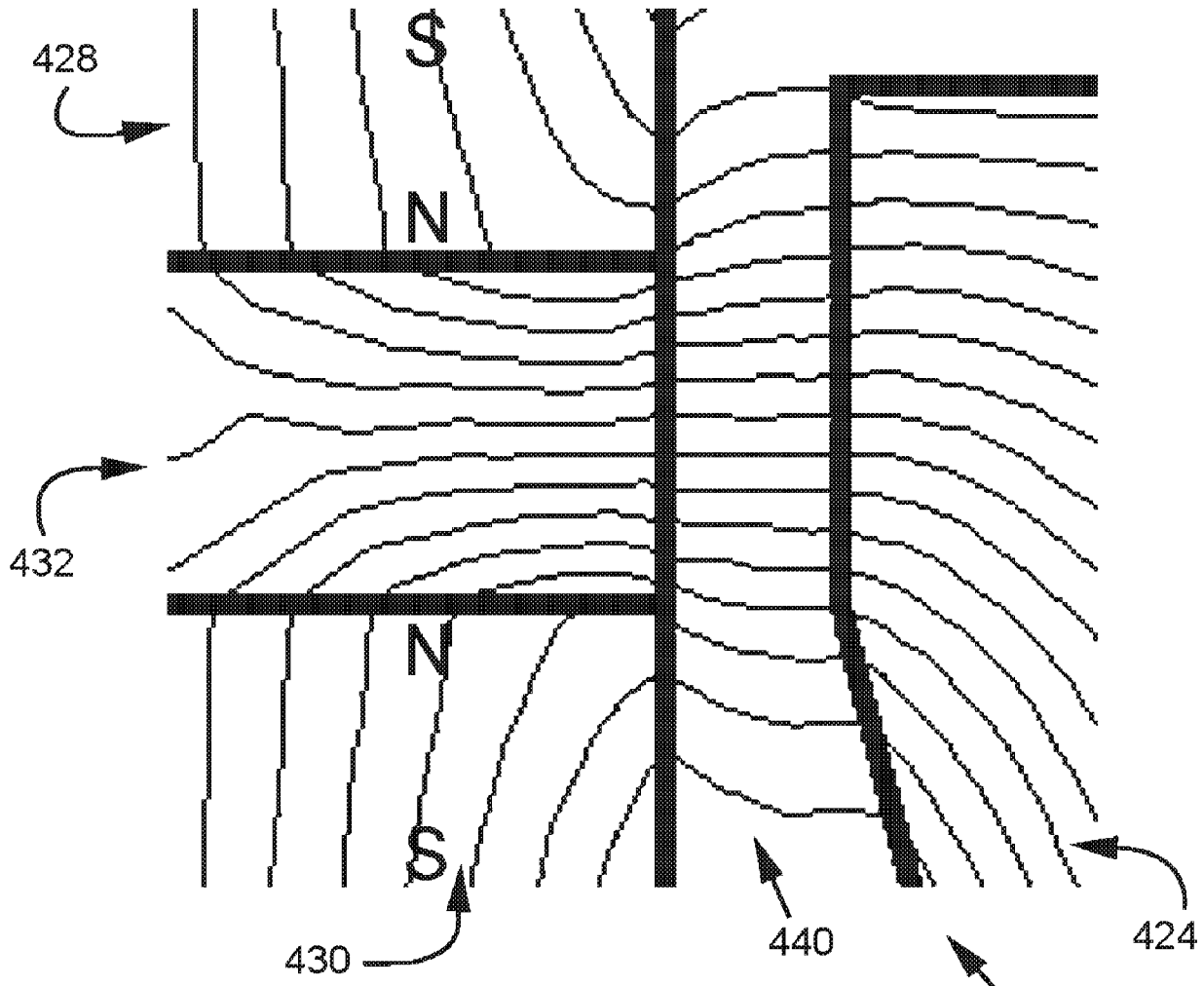
FIG. 16 illustrates a closer view of flux lines associated with the air gap of magnetic assembly of FIG. 11.

Now, additionally referring to FIG. 15, there is shown a closer view of air gap 140. The symmetry of the flux lines, even in this magnified view, show remarkable symmetry in air gap 140. Magnet pairs 128 and 130 as well as 136 and 138 are in a bucking configuration with similar poles facing each other. This arrangement dramatically increases the intensity of the magnetic field in air gap 140 between ferrous members 132 and 134. In contrast to the symmetry of the flux lines in FIG. 15, please now refer to FIG. 16, where the flux lines of the construct of FIG. 11 are shown in a closer view, where there is now less symmetry in the horizontal direction when vertically displaced from ferrous member 432.

Figure 17:
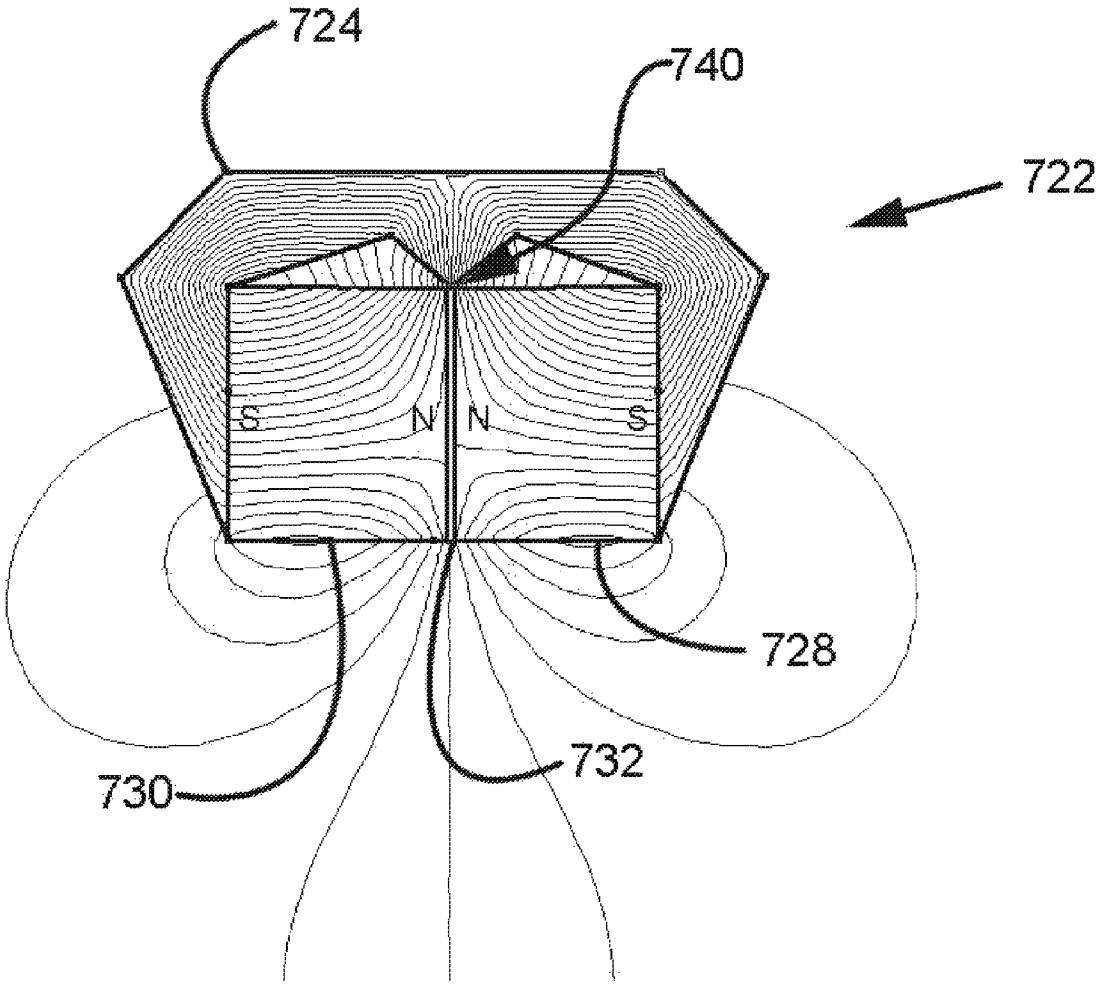
FIG. 17 illustrates a geometry of another embodiment of the present invention.

Now, additionally referring to FIG. 17, there is shown another geometry of the present invention for the production of an intense magnetic field in air gap 740. This rendition also has significant symmetry in the flux lines in air gap 740.

Figure 18:
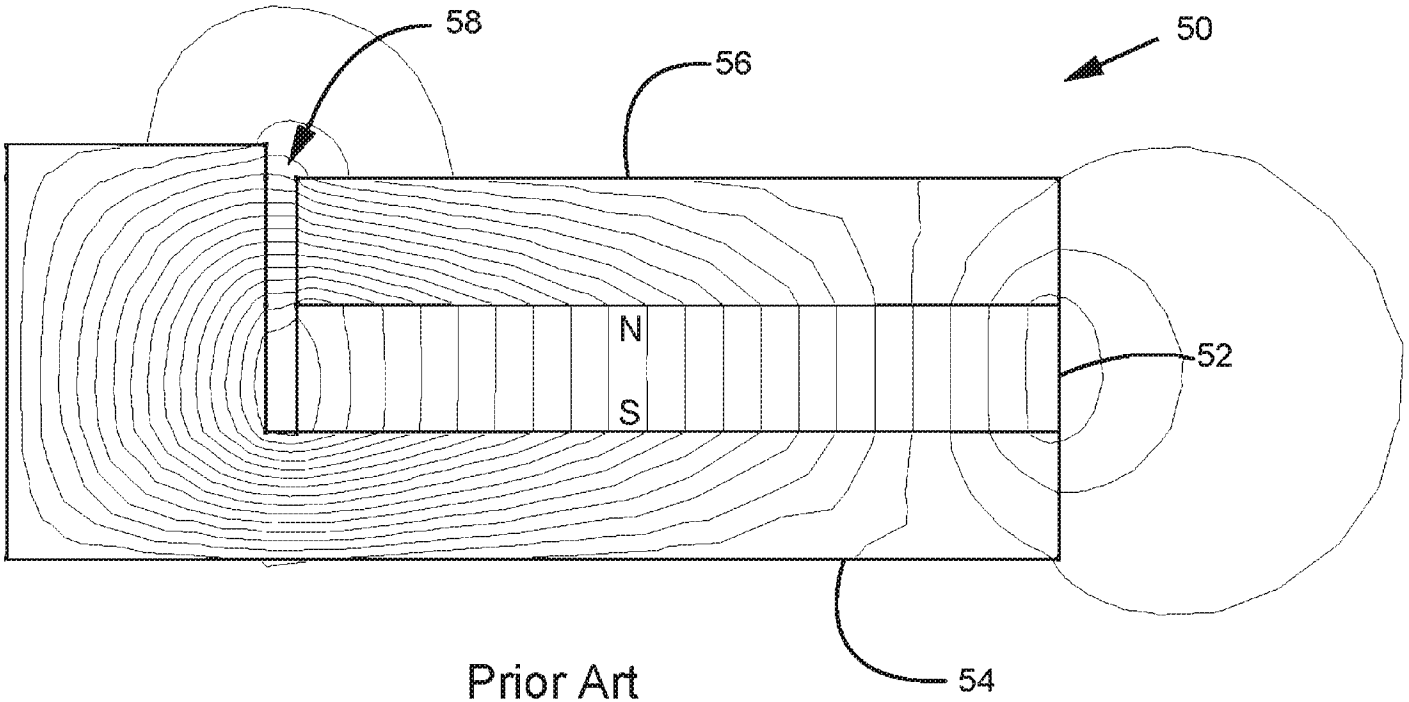
Prior Art Fig. 18
FIG. 18 illustrates the configuration of the prior art and the accompanying asymmetric flux lines in the air gap.

Now, additionally referring to FIG. 18 is a single magnet prior art configuration of a magnetic assembly 50 having a magnet 52, and ferrous pieces 54 and 56 positioned to form an air gap 58 that illustrates the asymmetrical magnetic flux lines of the prior art construct of a magnetic assembly 50.

Figure 19:
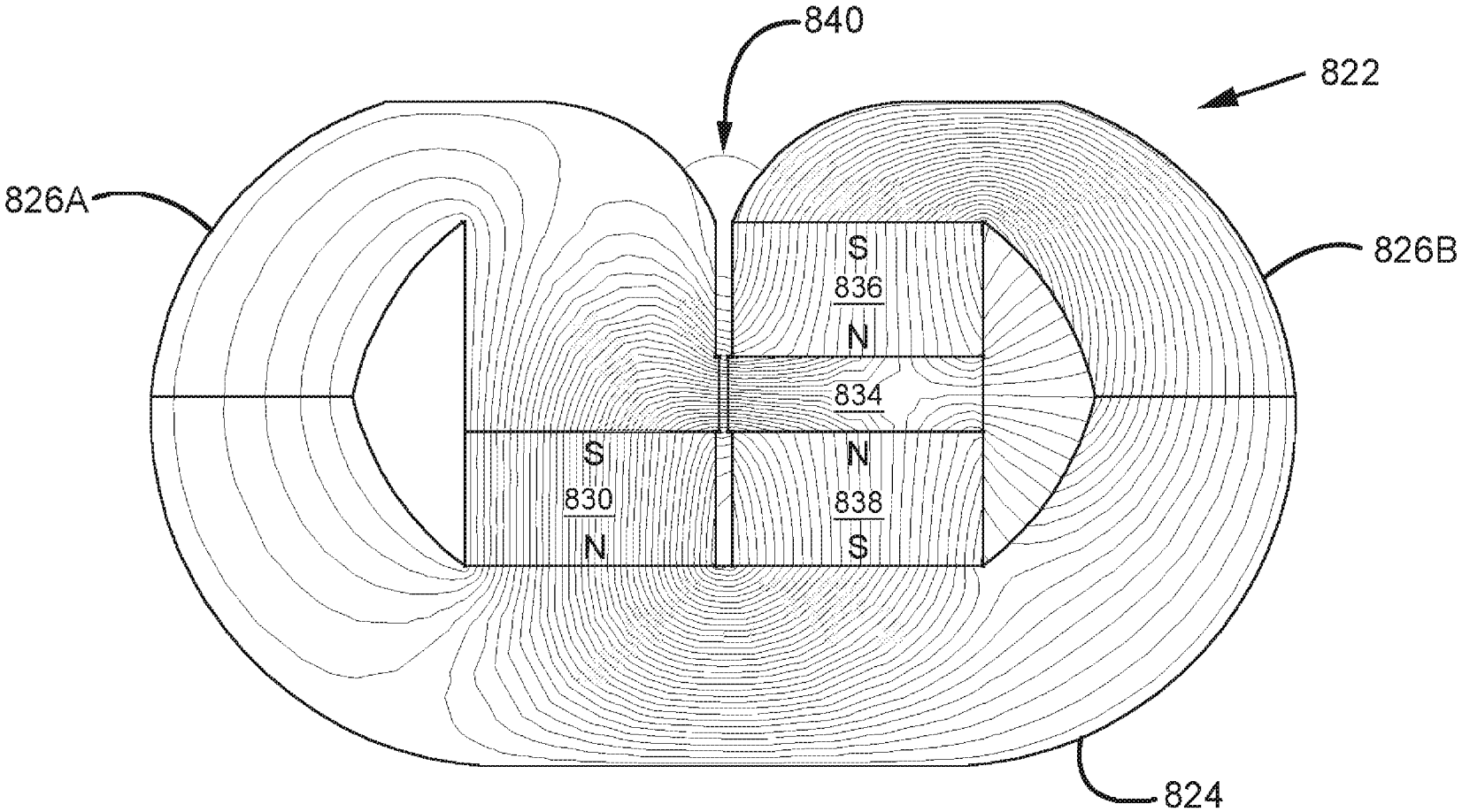
FIG. 19 illustrates a geometry of another embodiment of the present invention.

Now, additionally referring to FIG. 19 there is shown another embodiment of the present invention having three magnets 830, 836 and 838. Again, this is a cross-sectional view of one part of a ring magnetic assembly 822. Here the magnetic field emanating from the S pole of magnet 830 is magnetically proximate to the magnetic zone present in ferrous member 834.

Figure 20:
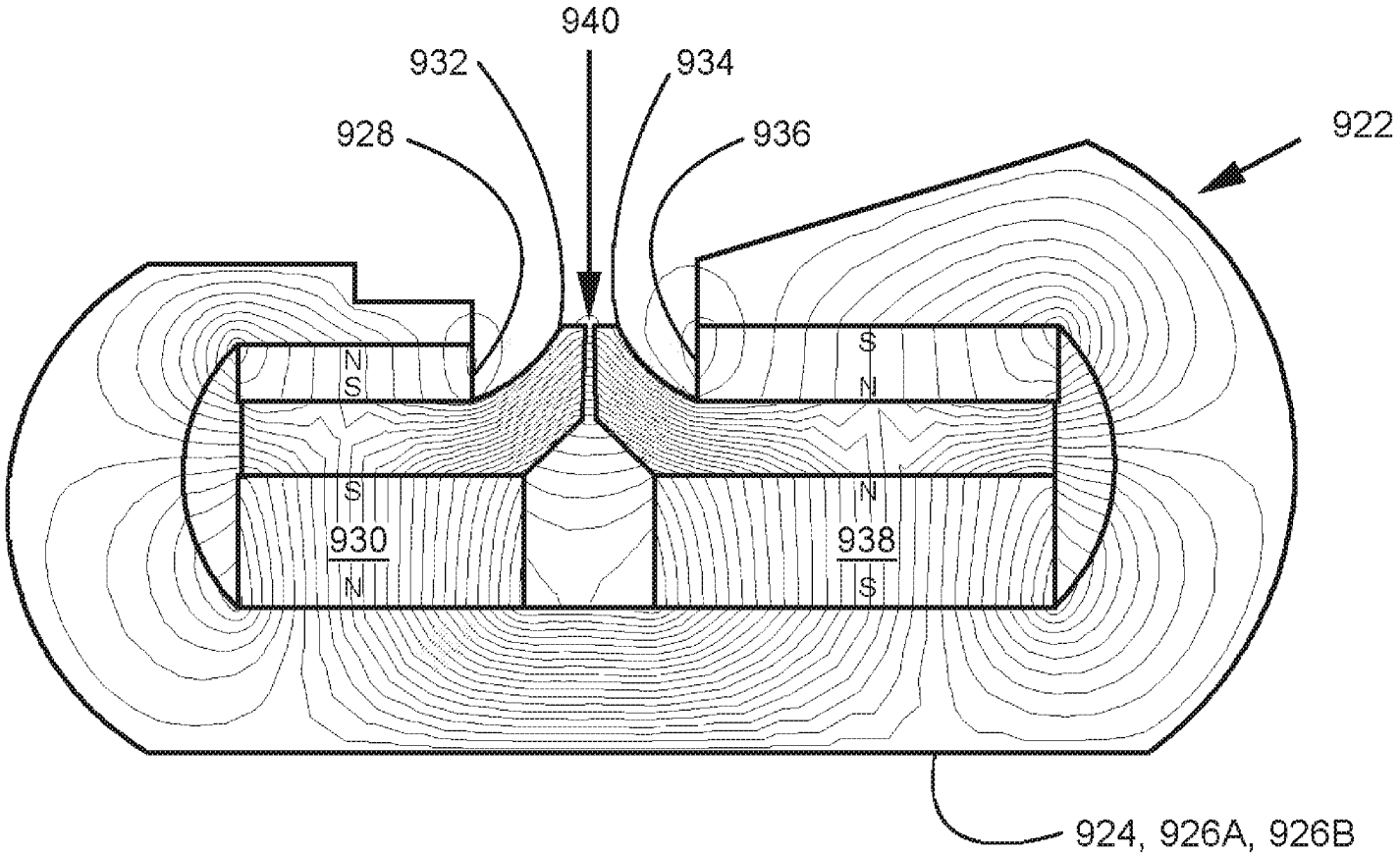
FIG. 20 illustrates a geometry of yet another embodiment of the present invention.

Now, additionally referring to FIG. 20 there is shown still yet another embodiment of the present invention having differing sizes of magnets 928, 930, 936 and 938, each also having differing magnetic strengths. Additionally, ferrous members 932 and 934 are shaped in an upward fashion to show the associated pathway of magnetic flux lines and the creation of an intense magnetic field in air gap 940.

Figure 21:
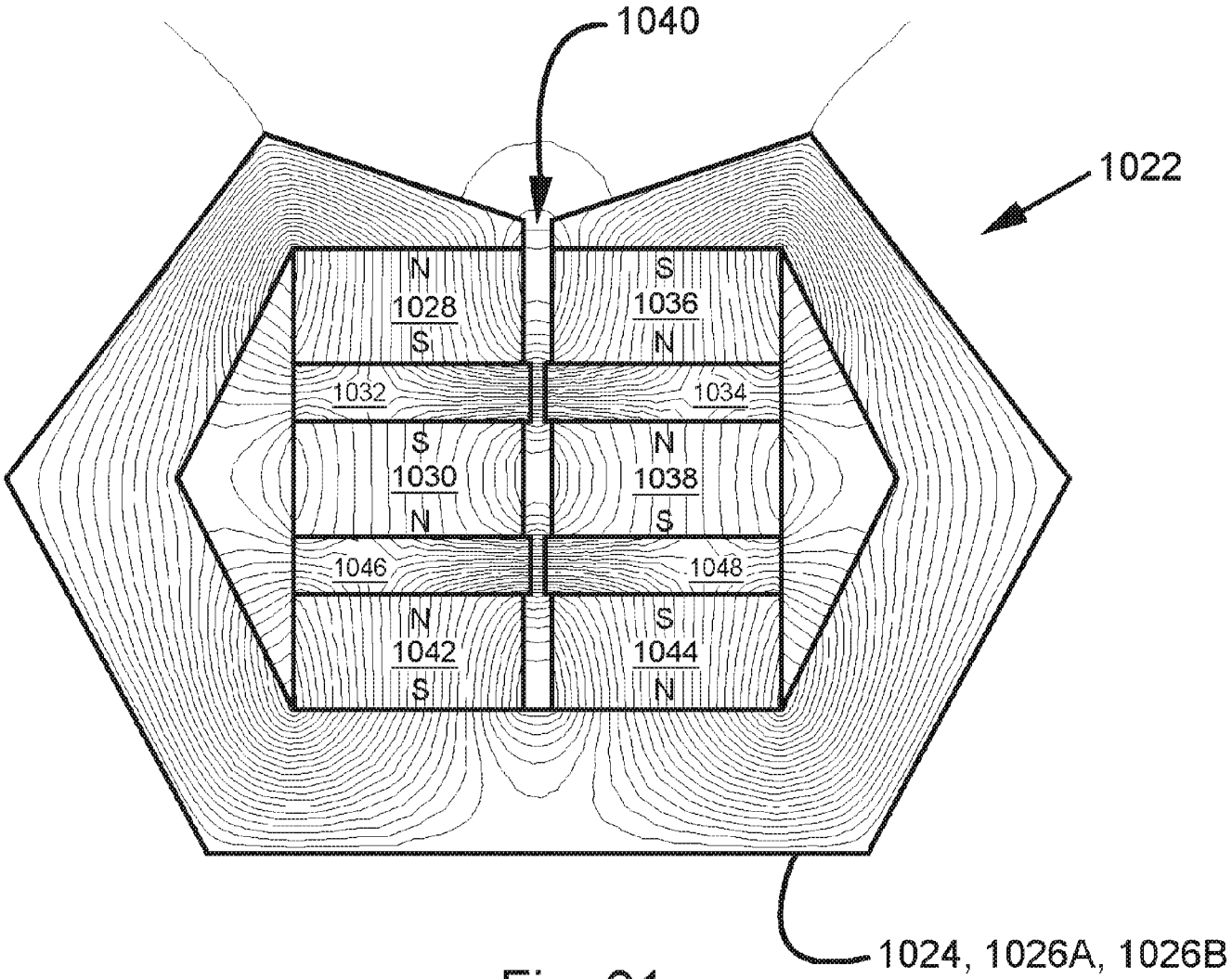
FIG. 21 illustrates a geometry of still yet another embodiment of the present invention.

Now, additionally referring to FIG. 21, there is shown a magnetic assembly 1022 (again in cross-section as a part of a ring magnetic assembly 1022 having magnets 1028, 1030, 1036, 1038, 1042 and 1044, and ferrous members 1032, 1034, 1046 and 1048 positioned between pairs of the magnets.

Generally the magnets are ring magnets with one set radially outward from the inner set. The magnetic pole orientations are in a bucking orientation so that the surrounding ferrous members 24, 26A and 26B not only provide a path for the magnetic lines to congregate, but also provide physical strength to hold magnetic assemblies 22 together. As can be seen in the figures the magnets generally are ring magnets having a common axis and several are positioned radially apart while the magnets that are axially spaced are in a magnetic bucking orientation. Also, pairs of radially separated magnets are concentrically located. It is also contemplated that the geometry of the magnetic assembly may have the radially apart magnets have their poles aligned in a bucking configuration and that magnetic zones be formed therebetween with an air gap being provided in either a radially inward manner or a radially outward manner.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A transducer, comprising:

a driven element;

a magnet assembly coupled to said driven element, said magnet assembly including:

a first magnet having a first magnetic pole and a second magnetic pole;

a second magnet having a first magnetic pole and a second magnetic pole, said first magnetic pole of said first magnet and said first magnetic pole of said second magnet being proximate to each other and facing each other thereby defining a first magnetic zone therebetween, said first magnetic poles all being similar, and said second magnetic poles all being similar; and a ferrous member coupling a substantial amount of a magnetic field emanating from said second magnetic poles and directing the substantial amount of the magnetic field to a gap between the ferrous member and the first magnetic zone wherein in the gap that is between said ferrous member and said first magnetic zone there is a substantially symmetrical magnetic field; wherein the substantially symmetrical magnetic field extends beyond said gap.

2. The transducer according to claim 1, wherein a side of said magnet assembly is not shielded.

3. The transducer according to claim 1, wherein said ferrous member extends from said second magnetic poles along one side of said magnet assembly.

4. The transducer according to claim 1, further comprising an other ferrous member positioned between said first magnetic poles.

5. The transducer according to claim 1, wherein said driven element includes a voice coil and a collar, said voice coil being coupled to said collar, said voice coil being positioned in said gap.

6. The transducer according to claim 1, wherein said first magnetic zone has a magnetic field strength of at least 2 Tesla between said first magnetic zone and said ferrous member.

7. The transducer according to claim 6, wherein said magnetic field strength is at least 3 Tesla.

8. The transducer according to claim 1, wherein said ferrous member has a C shaped cross-section.

9. A speaker system, comprising:

an enclosure; and a speaker mounted in said enclosure, the speaker including:

a driven element; and a magnet assembly coupled to said driven element, said magnet assembly including:

a first magnet having a first magnetic pole and a second magnetic pole;

a second magnet having a first magnetic pole and a second magnetic pole, said first magnetic pole of said first magnet and said first magnetic pole of said second magnet being proximate to each other and facing each other thereby defining a first magnetic zone therebetween, said first magnetic poles all being similar, and said second magnetic poles all being similar; and a ferrous member coupling a substantial amount of a magnetic field emanating from said second magnetic poles and directing the substantial amount of the magnetic field to a gap between the ferrous member and the first magnetic zone wherein in the gap that is between said ferrous member and said first magnetic zone there is a substantially symmetrical magnetic field; wherein the substantially symmetrical magnetic field extends beyond said gap.

10. The speaker system according to claim 9, wherein a side of said magnet assembly is not shielded.

11. The speaker system according to claim 9, wherein said ferrous member extends from said second magnetic poles along one side of said magnet assembly.

12. The speaker system according to claim 9, further comprising an other ferrous member positioned between said first magnetic poles.

13. The speaker system according to claim 9, wherein said driven element includes a voice coil and a collar, said voice coil being coupled to said collar, said voice coil being positioned in said gap.

14. The speaker system according to claim 9, wherein said first magnetic zone has a magnetic field strength of at least 2 Tesla between said first magnetic zone and said ferrous member.

15. The speaker system according to claim 14, wherein said magnetic field strength is at least 3 Tesla.

16. The speaker system according to claim 9, wherein said ferrous member has a C shaped cross-section.

* * * * *